United States Patent [19]

Mariani

[11] Patent Number: 4,575,979

[45] Date of Patent: Mar. 18, 1986

[54] BRACKET ASSEMBLY FOR SECURING WALL MEMBERS

[76] Inventor: Leonardo Mariani, 2528 Penn Ave., Pittsburgh, Pa. 15222

[21] Appl. No.: 638,910

[22] Filed: Aug. 8, 1984

[51] Int. Cl.[4] ..... E04B 2/74

[52] U.S. Cl. ..... 52/24; 52/712

[58] Field of Search ..... 52/241, 300, 481, 712

[56] References Cited

U.S. PATENT DOCUMENTS

| | | | |
|---|---|---|---|
| 3,073,420 | 1/1963 | Olsen | 52/481 X |
| 3,702,047 | 11/1972 | Harcuba | 52/241 |
| 3,832,813 | 9/1974 | Hindman | 52/241 X |
| 4,068,432 | 1/1978 | Davis | 52/241 X |
| 4,209,953 | 7/1980 | Wendt | 52/241 |
| 4,361,994 | 12/1982 | Carver | 52/241 X |
| 4,376,361 | 3/1983 | Michael | 52/241 |

*Primary Examiner*—John M. Jillions

*Attorney, Agent, or Firm*—Paul Bogdon

[57] ABSTRACT

A bracket assembly for securing a wall member, such as a drywall board, to a ceiling track is disclosed. The bracket assembly includes a housing formed of interconnected, generally parallel, planar face members having a generally J-shaped cross-section. An upper portion of a wall member is snugly received within the housing. A spring clip is engageable with the longer rear face member such that the spring clip may also engage a side section of a channel type ceiling track to thereby secure the housing and the confined wall member to the track.

1 Claim, 3 Drawing Figures

BRACKET ASSEMBLY FOR SECURING WALL MEMBERS

BACKGROUND OF THE INVENTION

This invention relates to a bracket assembly for securing a wall member, such as a drywall board, to a commonly used metal channel type ceiling track.

A common wall construction in commercial and institutional buildings is formed of drywall boards secured to metal studs. A partition is first formed of spaced vertical studs secured at their respective upper and lower ends to ceiling and floor tracks. Ceiling boards are first secured to the ceiling joists and then the wall boards are abutted to the ceiling boards and secured to both the vertical studs and the ceiling and floor tracks. The wall boards must be accurately sized to avoid any gap between a wall board and a ceiling board. Should a wall board be improperly sized, it may have to be removed and replaced. In addition to the problem of proper sizing, conventional room structures have another inherent problem, that being the inability to flex or move at the ceiling level. It is required in some structures that a ceiling flex or move in response to forces applied on the floor above the ceiling. Conventional room structures require somewhat complicated and expensive arrangements of the partition studs to achieve the desired ceiling movement. Without proper allowance for ceiling movement, damage to walls could result from the applied forces.

This invention overcomes the wall sizing and ceiling movement problems stated above, by providing a bracket assembly which receives the upper end portion of a wall board and secures the wall board to the ceiling track of the partition while allowing size deviations to the wall board and, in addition, permits movement of the ceiling with the housing portion of the assembly sliding on the wall board. Wall board replacement for improper sizing is eliminated by using this invention and ceiling movement is achieved without need of complicated and expensive stud arrangements. The bracket assembly of this invention is simple in structure, economical to manufacturer, and easy to use.

SUMMARY OF THE INVENTION

The bracket assembly of this invention is for use with a wall member, such as drywall board, for securing the wall member to a ceiling track forming part of a room partition structure. The bracket assembly, in its preferred form, includes a main housing having first and second spaced apart face members, and a flange member interconnecting the face members at one of their respective ends to define an opening at the other of the respective ends of the face members, the face members and the flange member being constructed and arranged such that at least a portion of the upper section of a planar wall member may be snugly and slidably received within the confines defined by the members. Clip means are provided to securely attach the bracket assembly housing and the confined wall member to a side face of a channel type ceiling track. The clip means of the preferred embodiment is a spring clip which is sized and shaped to fit on the rear face member of the bracket assembly and also to the side face of the ceiling track. The bracket assembly is secured to the ceiling track and the wall member inserted into the housing. Enough clearance is provided between the flange member and the upper end of the wall member to allow the bracket assembly to slide on the wall member when the ceiling flexes. The ceiling of the room will be made to abut the wall member below the front face member of the bracket assembly or the flange member will abut the ceiling board. In either case, the sizing of the wall member is not critical since the upper end of the wall member is confined within the bracket assembly and the upper end of the wall member does not directly abut the ceiling board.

Various other advantages, details, and modifications of the bracket assembly of the present invention will become apparent as the following description of a present preferred embodiment proceeds.

DESCRIPTION OF THE DRAWINGS

In the accompanying drawings, I show a certain preferred embodiment of this invention in which.

DETAILED DESCRIPTION OF A PREFERRED EMBODIMENT

Figure 1:
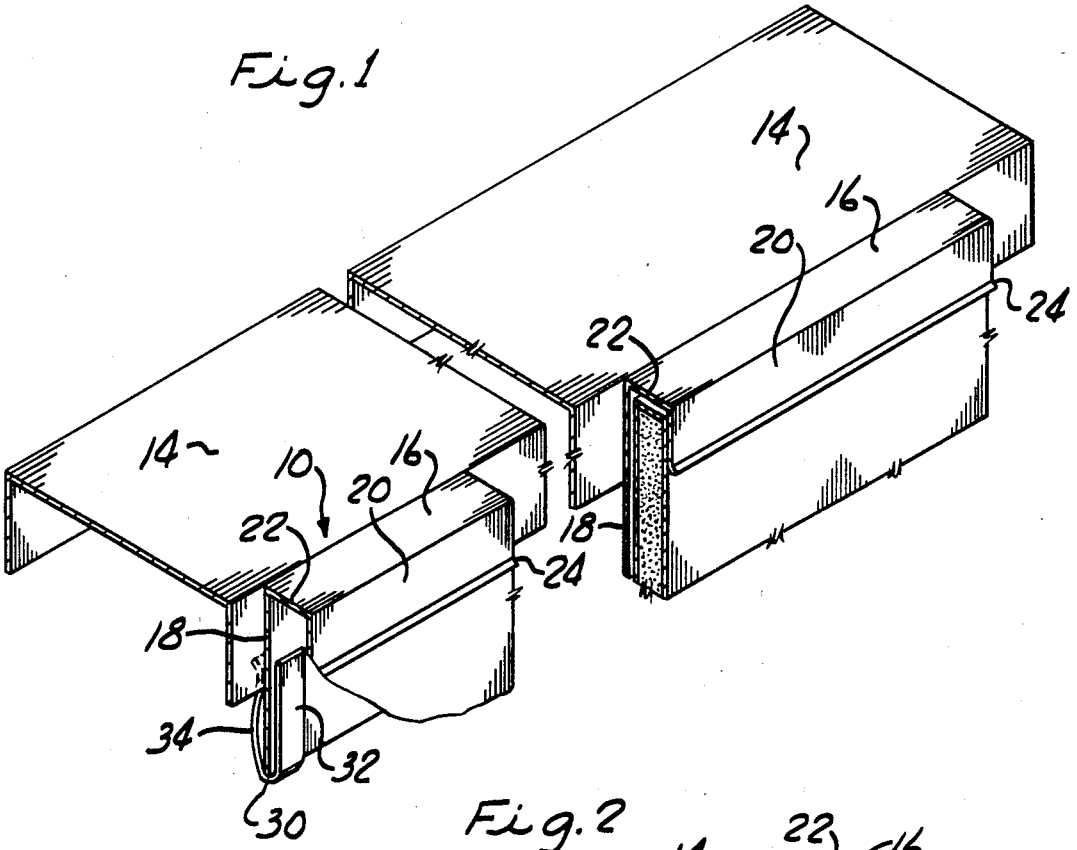
FIG. 1 is a perspective view of a preferred embodiment of the present invention showing the bracket assembly secured to a ceiling track with a wall member having its upper portion confined within the main housing of the assembly, and with parts cut away and the wall member shown incomplete to illustrate details of construction.

Referring now to the drawings there is illustrated a bracket assembly 10 of the present invention for securing a planar wall member such as drywall board 12 to a conventional channel type metal stud represented by ceiling track 14. The ceiling track 14 typically forms the upper structure of a room partition having vertical studs, not shown, connected with the ceiling track and a floor track, also not shown. The partition and its construction just described is old and well known in the building construction trade. The drywall board 12 is shown partially, and typically is a flat board of standard $4\times8$ feet in size and $\frac{3}{8}$, $\frac{1}{2}$, or $\frac{5}{8}$ inch thick.

The bracket assembly 10 includes a main housing 16 having an elongated planar rear first face member 18, typically about 3 inches in height, and an elongated planar front second face member 20, typically about 2 inches in height and parallel to the first face member and spaced $\frac{3}{8}$, $\frac{1}{2}$, or $\frac{5}{8}$ inch therefrom, depending on the thickness of the wall member to be supported by the bracket assembly 10. An elongated planar flange member 22 is fixed between the upper respective ends of the first and second face members 18 and 20, whereby the members, as arranged, define a structure having an opening at the lower respective ends of the first and second face members and having a generally J-shaped cross-section. A lip member 24 extends along the entire length of the second face member 20 and is arranged at an acute angle inclined away from the confines defined by the face members 18 and 20, and flange member 22. The lip member 24 arrangement permits insertions of a wall member into the housing 16 while avoiding the possible cutting of the wall member by the lower edge of the second face member 20.

Figure 2:
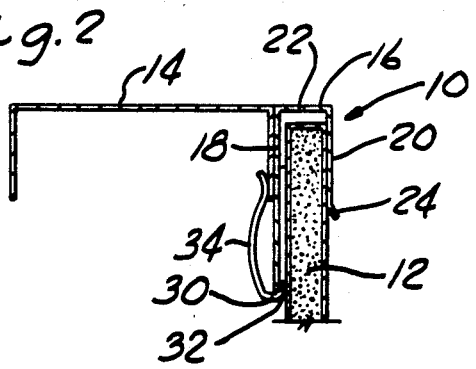
FIG. 2 is a side elevation view of the bracket assembly of FIG. 1 showing the upper portion of a wall member confined within the main housing.
Figure 3:
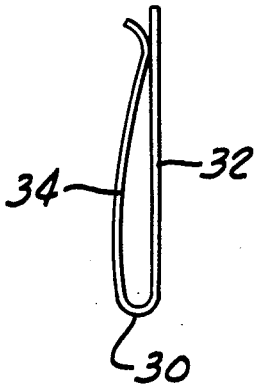
FIG. 3 is a side elevation view of the clip means forming part of the bracket assembly of the present invention, and illustrating the appearance of the clip means when standing alone and apart from the main housing.

A spring clip 30 engages the main housing 16 to secure the housing and the confined drywall board 12 to the ceiling track 14. The spring clip 30 is formed of a simple length of metal, typically about ½ inch wide, and has a planar front face 32 joined at its lower end to a double curved rear face 34. As shown in FIG. 3 the upper curved region of the rear face 34 will abut an upper portion of the frong face 32. The rear face 34 is biased in the direction of the front face 32 and may be pivoted away from the front face. The spring clip 30 has an overall length of about 2⅜ inches. As shown in FIGS. 1 and 2, the spring clip 30 is fitted over a portion of the rear first face member 18 of housing 16 and is mated to a side section of the ceiling track 14. Although only one spring clip 30 is illustrated a plurality of them, regularly spaced on the rear first face member 18, would be used to assure a secure joinder of the housing 16 and the confined drywall board 12 to the ceiling track 14.

It should be noted that the housing 16 is constructed and sized such that a clearance is provided between the flange member 22 and the upper end of the wall member 12. The clearance allows flexing or moving of the ceiling which would be arranged above the wall member 12. When the ceiling flexes the bracket assembly 10 slides on the upper portion of the wall member 12. Aside from allowing the ceiling flexing, the bracket assembly 10 permits use of wall members having heights which would ordinarily be improperly sized for directly abutting ceiling members.

It should now be clearly understood how the bracket assembly of this invention provides the advantages over conventional wall and ceiling construction, as recited heretofore in this specification. Also, is should be apparent to those skilled in this art that the bracket assembly of this invention may be modified in structure to accommodate particular needs without deviating from the scope of the invention.

While I have shown and described a certain preferred embodiment of this invention, it is to be distinctly understood that the invention is not limited thereto, but may be otherwise variously embodied and formed within the scope of the following claims.

I claim:

1. In combination with a channel type ceiling track used in forming room partitions, a bracket assembly for securing a planar wall member to the ceiling track, comprising:

a housing having first and second spaced apart generally parallel elongated face members, and a flange member interconnecting said face members at one of their respective ends to define an opening at the other of the respective ends of the face members and said first and second face members and said flange member being constructed and arranged such that at least a portion of the upper section of a planar wall member may be snugly and slideably received within the confines defined by said members;

said first and second face members having respective height dimensions considerably less than their respective length dimensions;

said first face member having a height dimension greater than the height dimension of said second member, whereby said housing has a generally J-shaped cross-section;

a lip member fixed to the free end of said second face member and extending at an acute angle away from the confines defined by said face members and said flange members; and at least one clip means removable from and engagable with said first face member of said housing for securing said housing to a side section of the ceiling track, said clip means having a planar front face and a curved rear face pivotably joined at one end to said front face, and said rear face being spring-biased in the direction of said front face.

* * * * *